US005740578A

United States Patent [19]

Moore

[11] Patent Number: 5,740,578

[45] Date of Patent: Apr. 21, 1998

[54] DUST MOP

[76] Inventor: Terry D. Moore, 2415 Hinton Rd., Dacula, Ga. 30211

[21] Appl. No.: 631,357

[22] Filed: Apr. 12, 1996

[51] Int. Cl.[6] ..... A47L 13/24

[52] U.S. Cl. ..... 15/147.2; 15/229.1; 15/230.19; 15/231

[58] Field of Search ..... 15/98, 147.1, 147.2, 15/228, 229.1–229.9, 230, 230.15, 230.17, 230.19, 231, 232

[56] References Cited

U.S. PATENT DOCUMENTS

| | | | |
|---|---|---|---|
| 736,736 | 8/1903 | Kane | 15/230.17 |
| 1,476,317 | 12/1923 | Zachry | 15/229.6 |
| 1,476,318 | 12/1923 | Zachry | 15/229.6 |
| 1,667,579 | 4/1928 | Zweig | 15/230.19 X |
| 2,301,586 | 11/1942 | Rubin | 15/228 |
| 2,306,944 | 12/1942 | Gray | 15/231 |
| 2,320,372 | 6/1943 | McCarthy | 15/229.7 |
| 5,249,329 | 10/1993 | Arnold | 15/230 |

FOREIGN PATENT DOCUMENTS

| | | | |
|---|---|---|---|
| 195031 | 3/1938 | Switzerland | 15/231 |
| 406800 | 3/1934 | United Kingdom | 15/231 |
| 965609 | 8/1964 | United Kingdom | 15/231 |

*Primary Examiner*—Mark Spisich
*Attorney, Agent, or Firm*—James B. Middleton

[57] ABSTRACT

A dust mop head is formed of a single sheet as a backing for pile yarns, with flaps integrally formed, the flaps having slits therein. A mop frame has inwardly directed tongues, and the flaps wrap around the frame so the tongues extend through the slits to hold the mop head to the mop frame. The mop heads can be formed by die cutting, either separately or in a continuous strip of backings. Pile yarns are subsequently attached, and the individual mop heads are separated from the continuous strip. If the mop head is to be launderable, one would use loop pile yarns and serge the edges of the backing.

13 Claims, 3 Drawing Sheets

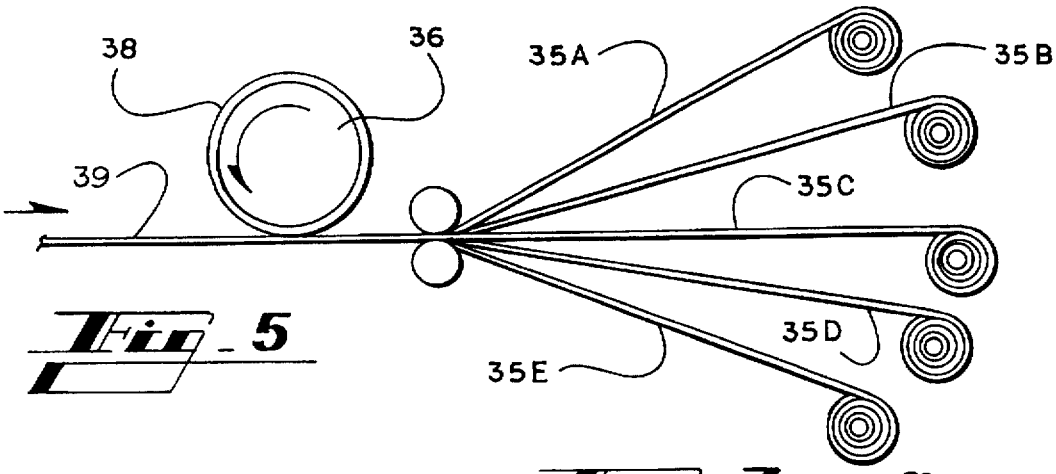
Fig_5
Fig_7
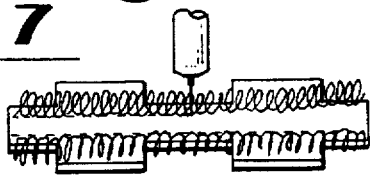
Fig_6
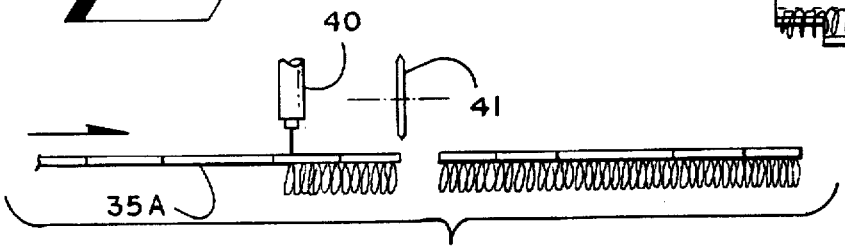
Fig_8
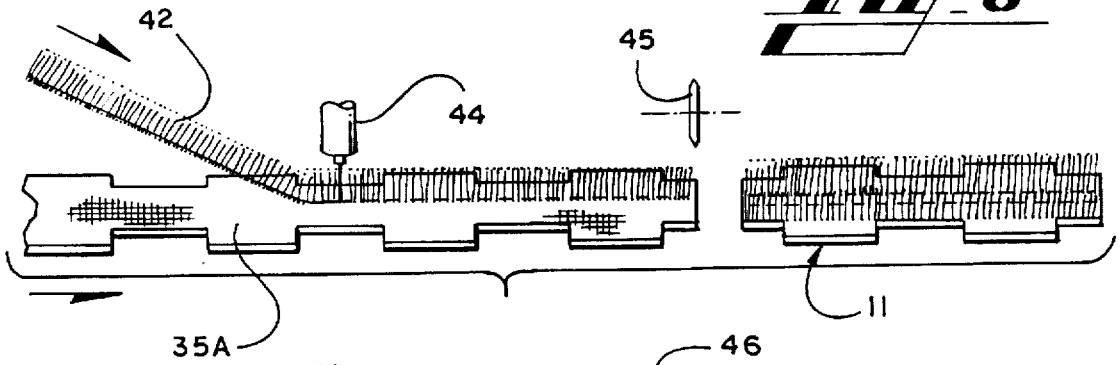
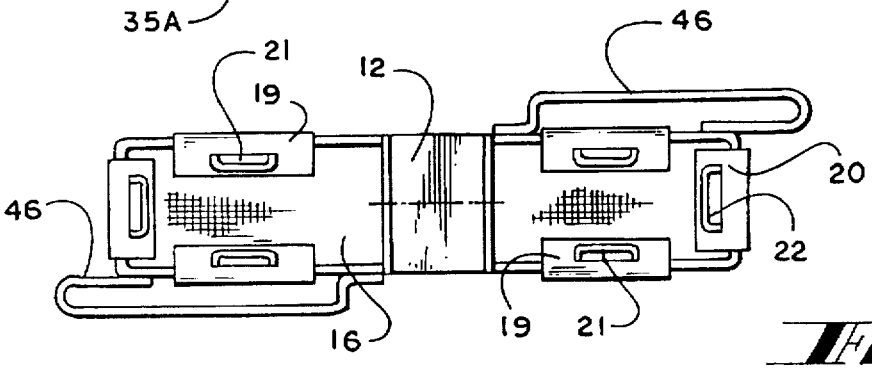
Fig_9

DUST MOP

BACKGROUND OF THE INVENTION

1. Field of the Invention

This invention relates generally to dust mops and the like, and is more particularly concerned with a novel dust mop and frame therefor, and a method for making the dust mop.

2. Discussion of the Prior Art

The conventional dust mop is designed with pockets on the upper side, and yarns on the lower side. The pockets receive the frame, and generally include a fastening means such as ties, snaps or the like, to hold the frame within the pockets. Most of the prior art mop heads have had pockets that have one opening to allow the frame to be received within the pocket, and the pocket then secured; however, U.S. Pat. No. 5,165,136 discloses a mop head designed to fit a mop frame having a bumper thereon, so the pockets are more open than usual. After receiving the mop frame, the pockets are closed by snaps or the like to hold the mop head on the frame. A major difficulty with the pockets of the prior art is that the mop head is produced in a plurality of different steps, requiring multiple handlings of several pattern pieces. The production system is therefore very inefficient.

There are several techniques for applying yarn to a mop head, and many of these are quite efficient in themselves. The problem is, again, the fact that each piece of the mop head must be handled several times. Also, the yarn is attached to one piece of fabric, which may be a fiber-filled polypropylene sheet, and additional pieces of fabric are sewn to the one piece of fabric to complete the mop head. A final step for a prior art mop head may therefore be to sew three or more layers of fabric together. This is of course a difficult task that is usually performed by a person, which both limits the output and increases the cost.

Thus, the prior art provides a mop frame, and a mop head receivable over the frame. The mop head has closable pockets to receive the mop frame therein, so the mop head is fixed around the frame. One prior art mop frame comprises a flat member of polymeric material, and a mop head is attached to the mop frame by hook and loop fasteners such as "Velcro" fasteners. While the mop head is attached to the mop frame rather than being wrapped around it, the attachment is by an intermediary. Furthermore, the polymeric mop frame is not as strong as the metal mop frames, and the hook and loop fastener does not provide a truly secure attachment.

SUMMARY OF THE INVENTION

The present invention provides a mop head having attaching means for cooperating with attaching means on a mop frame. The mop head itself is attached to the frame so the connection is secure, even during very hard use. The mop head, in accordance with a preferred embodiment, includes a plurality of flaps integral with the backing material of the mop head. Each flap is received over a tongue extending from the mop frame. As a result, the backing of the mop head itself is fixed to the mop frame. The mop frame can be made of metal as is usual, so maximum strength of the frame can be maintained; or, for light-duty applications, a polymeric or other material may be used.

The mop head backings of the present invention are preferably cut by means of a steel rule die or the like. Though any conventional technique can be used, it is preferred that the die be mounted on a rotary cylinder for high production. Then, depending on the production technique preferred, one can provide continuous strips of mop head backings to be cut apart later, or one can separate the individual pieces with the rotary die.

BRIEF DESCRIPTION OF THE DRAWINGS

These and other features and advantages of the present invention will become apparent from consideration of the following specification when taken in conjunction with the accompanying drawings in which:

FIG. 5 is a schematic illustration showing the process of cutting fabric into strips of mop head backings in accordance with the present invention;

FIG. 6 is a schematic illustration showing one technique for providing the yarns on the mop head backing;

FIG. 7 is a schematic illustration showing a different technique for providing the yarns on the mop head backing;

FIG. 8 is a view similar to FIG. 6 showing another technique for providing yarns on the mop head backing; and, FIG. 9 is a top plan view of a mop frame and head made in accordance with the present invention, the frame being provided with bumpers.

DETAILED DESCRIPTION OF THE EMBODIMENTS

Figure 1:
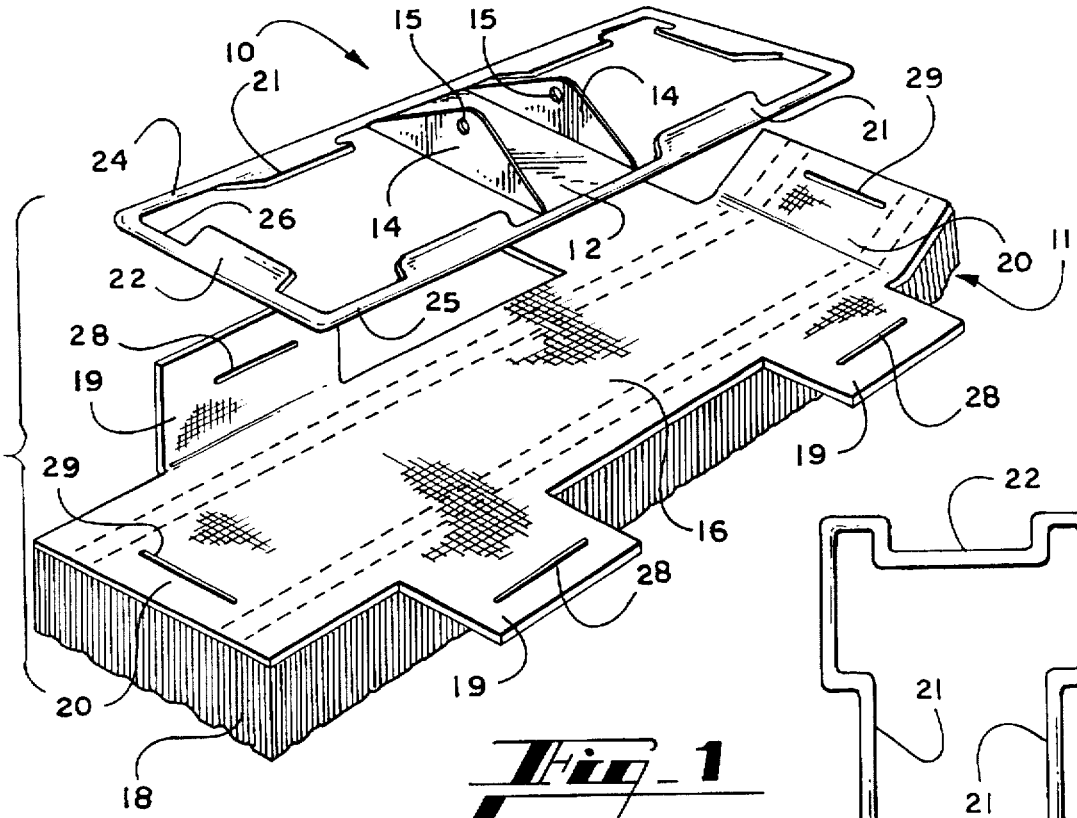
FIG. 1 is an exploded perspective view showing a mop frame and mop head made in accordance with the present invention.

Referring now more particularly to the drawings, and to those embodiments of the invention here presented by way of illustration, FIG. 1 shows a mop frame generally designated at 10 and a mop head generally designated at 11. It will be seen that the mop frame 10 is generally rectangular and includes a central support member 12. Those skilled in the art will understand that the support member 12 can take any form needed to connect the mop frame 10 to a device for utilizing the mop. Such a device may be a simple handle for a push mop, or a mechanical device such as that shown in U.S. Pat. No. 4,989,288. The support 12 is here shown as including a pair of upstanding plates 14 having holes 15 therethrough. Such an arrangement will allow connection of most of the popular equipment, but the present invention is not limited to the type of support means 12, and that shown is only by way of illustration.

The mop head 11 shown in FIG. 1 includes a generally rectangular portion 16 which has a plurality of yarns 18 fixed thereto. As will be discussed in more detail hereinafter, the yarns 18 may be fixed to the backing by any of several techniques.

Extending from the rectangular portion 16 is a plurality of flaps 19 and 20, the flaps 19 extending from the front and rear of the mop head (based on the direction of movement), and the flaps 20 extending from the ends of the mop head. Thus, the rectangular portion 16 of the mop head 11 will generally cover the rectangular frame 10, and the flaps 19 and 20 will wrap around the frame to secure the mop head 11 to the mop frame 10.

Figure 2:
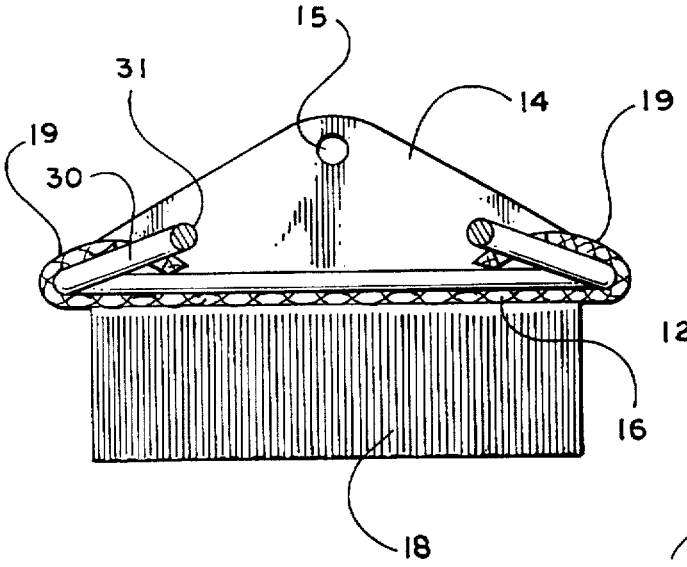
FIG. 2 is a cross-sectional view showing a mop head attached to a frame made in accordances with the present invention.

It will be noticed that the mop frame 10 has a plurality of tongues 21 and 22, the tongues 21 extending from the front and rear members 24 and 25 of the frame 10 and the tongues 22 extending from the end members 26. For cooperation with the tongues 21 and 22, the flaps 19 and 20 define slits 28 and 29. The slits 28 can therefore be slipped over the tongues 21, then the slits 29 can be slipped over the tongues 22. Even though the fit is preferably rather snug, the backing material has enough stretch to allow the mop head to be installed relatively easily. As shown in FIG. 2 of the drawings, the tongues 21 and 22 may be angled slightly upwardly.

While the tongues 21 and 22 and slits 28 and 29 are here shown as connecting means for connecting the mop head to the mop frame, those skilled in the art will understand that other connecting means may be used if desired. Various forms of clamping devices can be used to clamp the flaps 19 and 20 to the mop frame 10, and the device will be equally effective; or, snaps or the like may be used, but they tend to be more expensive. The slits and tongues here shown are preferred because of their simplicity to use and their economy in production.

Figure 3:
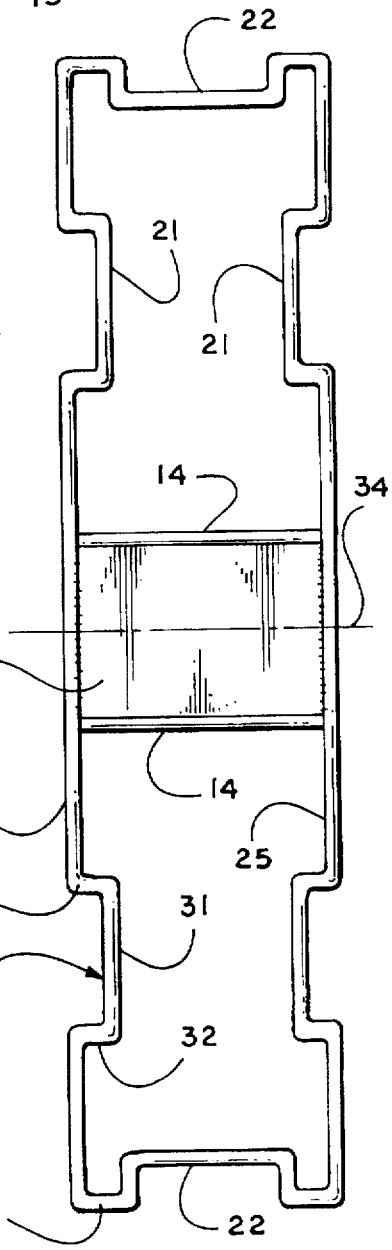
FIG. 3 is a top plan view showing one form of frame made in accordance with the present invention.

In FIG. 1 of the drawings it will be noticed that the tongues 21 and 22 are formed by flange-like members that may be integrally formed with the mop frame 10, or may be subsequently attached. Another technique for providing the tongues 21 and 22 is illustrated in FIG. 3 of the drawings, the frame of FIG. 3 also being shown in FIG. 2. The mop frame in FIGS. 2 and 3 is formed of wire, or rod, bent into the proper shape. Thus, the tongues 21 and 22 are formed by bending the wire inwardly and perhaps somewhat upwardly to form the inwardly directed sections 30, then bending at 90° to form the longitudinal section 21, and finally bending back parallel to the section 30 to form section 32. Each of the tongues 21 and 22 is similarly formed, so the description will not be repeated.

If the frame is made of a single piece of wire, the wire must of course be joined to itself to make the closed mop frame 10, and the joint is preferably at the center support 12. By placing the joint at 34, both ends of the wire are well supported by being welded to the support 12. The joint will therefore be very strong and durable. It will also be understood that the frame may be made in two pieces, and two joints can be made at the support 12.

Figure 4:
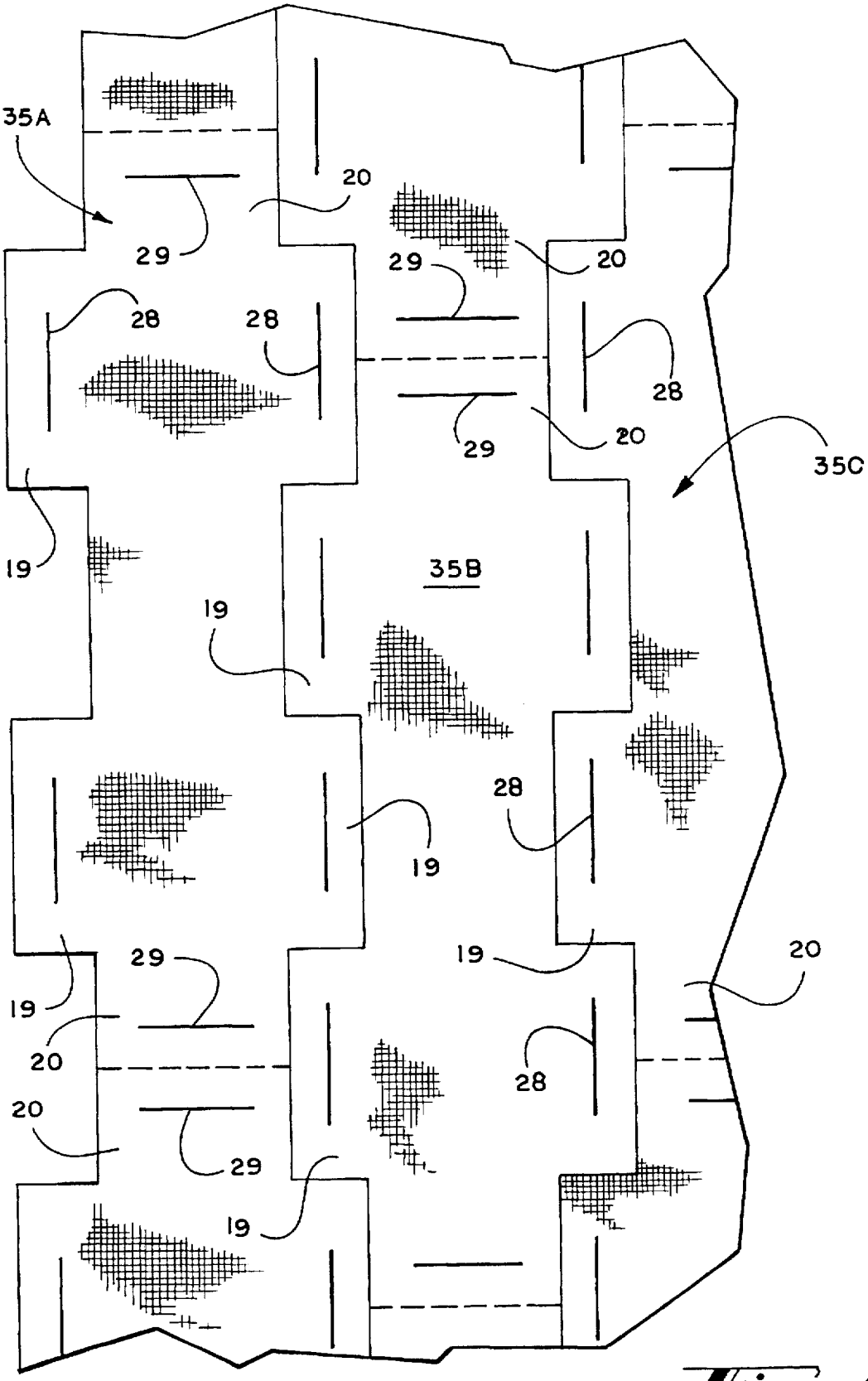
FIG. 4 is a plan view showing the preferred layout of mop head backing pieces in accordance with the present invention.

One advantage of the particular configuration of the mop head 11 is economy in production. Those skilled in the art will understand that the prior art mop heads include a plurality of different pattern pieces. Some of the pattern pieces are typically rough-cut, and subsequently die-cut to the exact size. As a result, there is a fabric waste both in trying to fit the various pattern pieces on a piece of fabric, and in providing the large sizes to be subsequently cut to proper size. In the mop head of the present invention, the design is such that a plurality of the mop head patterns fit together on a piece of fabric with almost no waste. FIG. 4 of the drawings illustrates the layout.

In looking at FIG. 4 of the drawings, it should be pointed out that the mop head backings are to be cut by a steel rule die of the type mounted on a cylinder. The pattern repeat will be exactly the circumference of the cylinder, so production can be continuous. Depending on the sizes of the cylinder and the mop heads being made, there may be two or more mop head patterns in the circumference of the cylinder. FIG. 4 shows three mop head patterns side-by-side. It should be understood that the sequence will be repeated over the full width of the cylinder carrying the die.

As will be discussed further hereinafter, the mop head patterns may be cut into a plurality of strips 35A, 35B and 35C, the strips being either rolled or fed directly to the next manufacturing step, or the patterns may be cut into individual mop head patterns. To provide strips 35A etc., the broken lines representing the ends of the patterns will not be cut by the steel rule die, but such cutting will be a subsequent step in the manufacturing process. To provide individual mop head patterns, the broken lines will be cut by the steel rule die, and all the pieces will be separate as they leave the steel rule die.

With attention now to both FIG. 1 and FIG. 4, it can be seen that each mop head pattern includes the rectangular center section 16 with flaps 19 and 20. Each of the flaps 19 has a width equal to the spacing between the flaps. Because of this spacing, it can be seen that the flaps 19 on the strip 35A extend into the space between the flaps 19 on the strip 35B. Furthermore, two of the end flaps 20 have a length equal to the width of one flap 19, so a flap 19 on the strip 35A lies next to the end flaps 20 on successive patterns on the strip 35B. Adjacent strips 35A, 35B etc. thus nest together so that there is no wasted fabric. The only scrap will be the space between flaps 19 at the two edges of the fabric, and some scrap at the beginning and end of the length of fabric.

With the above and foregoing description in mind, attention is directed to FIGS. 5–8 for a discussion of the process for making the mop heads 11 of the present invention. FIG. 5 illustrates the process described above wherein a cylinder 36 has a steel rule die 38 on its circumference. Fabric 39 is fed to the die 38, and a plurality of strips 35A, 35B etc. is formed, the strips being separately rolled as shown. Those skilled in the art will recognize that the strips may, alternatively, be bulk packed, or simply dropped into a container without rolling.

Those skilled in the art will understand that there are several ways to attach yarn to a backing to make a dust mop. The present invention utilizes the prior art methods for attaching yarn, and may use any of the prior art techniques, depending on which one best fits the mop head making process being used. FIG. 6 shows a strip of pattern pieces, such as a strip 35A, being fed to a tufting machine represented by the needle 40. In this process, the yarn is tufted directly into a backing material, the backing material being the mop head pattern piece. Since the pattern pieces are in a continuous strip, the tufting can be continuous for high productivity. After tufting, the individual pattern pieces will be separated as by the rotary knife 41. Looking at FIG. 4, it will be seen that one must simply cut between adjacent slits 29. Some error in the placement of the cut will not affect the mop head, so long as the slits 29 are not damaged.

Sometimes the yarn is applied to a dust mop head by pre-forming a strand of looped yarn, and subsequently sewing lengths of the strand to the backing fabric. This is illustrated in FIG. 7 where a separate pattern piece is shown rather than a continuous strip. An appropriate number of strands will be sewn to the piece, this usually being accomplished by hand sewing.

FIG. 8 illustrates another continuous process, a strip 35A being shown. Also, a continuous strand 42 of pre-formed yarn is shown being married with the strip 35A and sewn thereto by a sewing machine 44. Though only one strand 42 is here shown, two or more such strands may be attached, either simultaneously or successively. After all the yarn has been attached, the individual pieces are separated, as by the rotary knife 45.

When dust mops are carried by a motorized vehicle, it is desirable to provide bumpers to protect the dust mops as they engage pallets, boxes or the like. Such bumpers are disclosed in U.S. Pat. No. 5,155,884. The mop heads of the present invention are admirably adapted for use with bumpers as shown in FIG. 9. The flaps 19 can pass inside the bumper 46 and attach to the tongue 21, so the bumper 46 does not interfere with the above described operation of the mop head and frame.

It should now be understood that the mop head of the present invention can be made by die cutting the single piece backing from fabric, and attaching yarn to the backing. If the yarn is attached while the pattern pieces are in a strip the pieces must be separated. With these few steps, a complete mop head has been made. It is contemplated that the backing fabric will be cotton, and the yarn will be cotton, so the backing will assist in holding dust. When the mop is dirty, it will be disposed of; but, the cost is so low that the use of such mops is very economical. It will be obvious, however, that other fabrics can be used, including synthetic yarns, non-woven backing fabrics and the like. Those skilled in the art will readily select the fabrics to provide the particular mop desired.

The above described mop is not considered to be launderable because the fabric will ravel, and the yarns will ravel. To make a launderable mop, therefore, one can simply protect the edges of the fabric, and use a looped yarn, or continuous yarn, as the yarn on the mop. Protecting the edges of the fabric can be done by serging, as is well known in the art. If the fabric contains a quantity of thermoplastic yarn, one could heat seal the edges, by a heated die, by ultrasonics or the like.

Though the mop has been described as rectangular, it should be recognized that specialty mops can also be made using the same technique; therefore, the present invention contemplates mop heads and frames in various shapes to suit any particular need.

It will therefore be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. A dust mop comprising a mop frame and a mop head, said mop frame selectively carrying said mop head, said mop head comprising a backing, a plurality of pile yarns fixed to said backing, and a plurality of flaps extending from said backing, said mop frame including front and rear frame members, and attaching means fixed to said front and rear frame members and comprising a plurality of tongues for selectively securing said plurality of flaps to said mop frame, said plurality of flaps being received by said plurality of tongues.

2. A dust mop as claimed in claim 1, wherein said plurality of flaps are integral with said backing.

3. A dust mop comprising a mop frame and a mop head, said mop frame selectively carrying said mop head, said mop head comprising a backing, a plurality of pile yarns fixed to said backing, and a plurality of flaps extending from said backing, said mop frame including attaching means for selectively securing said plurality of flaps to said mop frame, each flap of said plurality of flaps defining a slit therein for cooperating with said attaching means on said mop frame.

4. A dust mop as claimed in claim 3, wherein said attaching means comprises a plurality of tongues fixed to said mop frame, each tongue of said plurality of tongues being located to receive said slit in one of said plurality of flaps.

5. A dust mop as claimed in claim 4, wherein said plurality of flaps comprises a first group of flaps extending from the front and rear of said mop head, and a second group of flaps extending from the ends of said mop head.

6. A dust mop comprising a mop frame and a mop head, said mop frame selectively carrying said mop head, said mop head comprising a backing, a plurality of pile yarns fixed to said backing, and a plurality of flaps extending from said backing, said mop frame including attaching means for selectively securing said plurality of flaps to said mop frame, said mop frame being formed of wire, said wire being bent for providing tongues, said tongues constituting said attaching means.

7. A dust mop as claimed in claim 6, wherein each flap of said plurality of flaps defines a slit therein for receiving one of said tongues therethrough.

8. A backing piece for a mop head, said backing piece comprising a rectangular body having a front edge, a rear edge and opposed end edges, a plurality of first flaps extending from said front edge and a plurality of second flaps extending from said rear edge, said first flaps being separated by a first distance, said second flaps being separated by said first distance, the width of said first flaps and said second flaps being equal to said first distance.

9. A backing piece as claimed in claim 8, and further including a pair of third flaps extending from said opposed end edges of said body, said third flaps having a width substantially equal to the length of said end edge, and a length equal to approximately one-half said first distance.

10. A backing piece as claimed in claim 9, wherein said first flaps and said second flaps are aligned with each other.

11. A dust mop frame, for use with a mop head carried thereby, said mop frame comprising an open frame consisting of a plurality of frame members joined to one another and including parallel front and rear frame members, a support means fixed between said front and rear frame members, and a plurality of attaching means for selectively attaching a mop head to said mop frame, said plurality of attaching means comprising a plurality of tongues fixed to said front and rear frame members.

12. A dust mop frame as claimed in claim 11, wherein said mop frame is rectangular, and each frame member of said plurality of frame members includes at least one of said attaching means.

13. A dust mop frame for use with a mop head carried thereby, said mop frame comprising a plurality of frame members joined to one another, a support means fixed to at least one of said frame members, and a plurality of attaching means for selectively attaching a mop head to said mop frame, said plurality of attaching means being fixed to said plurality of frame members, wherein said frame members are formed of wire, said wire being bent for defining said plurality of frame members and said attaching means.

* * * * *